US009810189B2

(12) United States Patent
Maier et al.

(10) Patent No.: US 9,810,189 B2
(45) Date of Patent: Nov. 7, 2017

(54) FUEL DISTRIBUTOR

(75) Inventors: Martin Maier, Moeglingen (DE); Martin Goehner, Vaihingen (DE); Markus Feigl, Markgroeningen (DE); Helmut Schneider, Aichtal (DE); Nikolaus Hautmann, Ditzingen (DE); Dietmar Uhlenbrock, Stuttgart (DE); Holger Uhrig, Memmelsdorf (DE)

(73) Assignee: ROBERT BOSCH GMBH, Stuttgart (DE)

( * ) Notice: Subject to any disclaimer, the term of this patent is extended or adjusted under 35 U.S.C. 154(b) by 865 days.

(21) Appl. No.: 13/609,694

(22) Filed: Sep. 11, 2012

(65) Prior Publication Data

US 2013/0068198 A1 Mar. 21, 2013

(30) Foreign Application Priority Data

Sep. 15, 2011 (DE) ..... 10 2011 082 743

(51) Int. Cl.
*F02M 69/50* (2006.01)
*F02M 55/02* (2006.01)

(52) U.S. Cl.
CPC ..... *F02M 69/50* (2013.01); *F02M 55/025* (2013.01); *F02M 2200/25* (2013.01); *F02M 2200/26* (2013.01); *F02M 2200/315* (2013.01); *F02M 2200/857* (2013.01)

(58) Field of Classification Search
CPC ..... F02M 35/10216; F02M 47/027; F02M 55/004; F02M 55/005; F02M 55/02; F02M 55/025; F02M 55/04; F02M 59/366; F02M 61/14; F02M 61/145; F02M 61/168; F02M 61/205; F02M 63/0225; F02M 69/465; F02M 2200/315; F02M 2200/858
USPC ..... 123/456, 467–470; 285/223–237, 298, 285/31–32, 369; 277/359–364; 248/67.7; 384/152
See application file for complete search history.

(56) References Cited

U.S. PATENT DOCUMENTS

| | | | | |
|---|---|---|---|---|
| 4,091,676 | A * | 5/1978 | Niskin | 73/864.67 |
| 5,141,258 | A * | 8/1992 | Stine | 285/31 |
| 5,713,323 | A * | 2/1998 | Walsh et al. | 123/184.42 |
| 6,854,769 | B2 * | 2/2005 | Lutzer | 285/226 |
| 7,469,680 | B2 * | 12/2008 | Merchant et al. | 123/456 |
| 2003/0145831 | A1 * | 8/2003 | Liskow | 123/470 |
| 2004/0094955 | A1 * | 5/2004 | Bettinger | 285/302 |

(Continued)

FOREIGN PATENT DOCUMENTS

CN 1478176 A 2/2004

*Primary Examiner* — Stephen K Cronin
*Assistant Examiner* — Susan Scharpf
(74) *Attorney, Agent, or Firm* — Norton Rose Fulbright US LLP; Gerard Messina

(57) ABSTRACT

A fuel distributor, which is used, in particular, for fuel injection systems of mixture-compressing, internal combustion engines having externally supplied ignition, includes a distributor pipe, a first holder and at least one second holder. The distributor pipe has a longitudinal axis. In this connection, the first holder and the second holder are situated at the distributor pipe so as to be axially set apart from one another with respect to the longitudinal axis. The distributor pipe is designed to allow axial length compensation. It is also possible for at least one holder to be designed to allow axial length compensation.

9 Claims, 4 Drawing Sheets

(56) References Cited

U.S. PATENT DOCUMENTS

2004/0222626 A1* 11/2004 Baruh ..... 285/15
2007/0290502 A1* 12/2007 Fernandes et al. ..... 285/226

* cited by examiner

FUEL DISTRIBUTOR

CROSS REFERENCE TO RELATED APPLICATION

The present application claims priority to Application No. DE 10 2011 082 743.9, filed in the Federal Republic of Germany on Sep. 15, 2011, which is expressly incorporated herein in its entirety by reference thereto.

FIELD OF INVENTION

The present invention relates to a fuel distributor, which is used, in particular, for fuel injection systems of mixture-compressing, internal combustion engines having externally supplied ignition. The present invention particularly relates to the area of fuel injection systems configured as medium pressure systems.

BACKGROUND INFORMATION

In fuel injection systems of motor vehicles, it is conceivable for a fuel distributor rail to be used that is made of steel for high-pressure applications. By this means, a pressure resistance for pressures of greater than 15 MPa (150 bar) may be achieved. Such a high-pressure steel rail may be made of soldered rail. In this connection, a steel pipe is used as a base, to which the individual components, in particular, screw caps, bolt-on holders, a high-pressure connection and the interfaces to the injector are soldered. However, this development is associated with high manufacturing costs.

In addition, in the case of such a high-pressure rail, there is the problem of mechanical stresses occurring in the rail. The steel rail may be mounted on a cylinder head, which, as a rule, is made of aluminum. If the engine heats up, then thermal expansion occurs. In this connection, the rail expands, which generates stresses in the rail.

In addition, high manufacturing costs result when such a rail is made up of components. In particular, e.g., a drawn pipe must be cut to length, the ends must be machined, and outlets must be bored. In addition, a wall thickness must be selected to be relatively high, in order that the internal pressure and, additionally, the impeded linear expansion may be absorbed. Thus, the wall thickness may not be oriented to the internal pressure alone, since the wall thickness would then be under-dimensioned for reasons of strength. Cups and holders may be made of finished steel castings or small assemblies or deep-drawn parts. Lathed or deep-drawn parts may be used as top-caps. The high-pressure connections may take the form of lathed parts, for example. However, prior to the final soldering operation, the attachment parts must still be fixed in position with respect to one another. On the whole, such conceivable manufacturing of a rail results in a highly cost-intensive manufacturing process having many working steps.

SUMMARY OF THE INVENTION

The fuel distributor of the present invention has the advantage that a fuel distributor suitable for a medium pressure may be produced at comparatively low manufacturing costs. A particular advantage is that a material usage, in particular, the dimensioning of a distributor pipe, may be optimized. By this means, a material savings is achieved and processing, e.g., reshaping, is made easier.

It is advantageous that the distributor pipe has at least one compensating location, which is situated between the first holder and the second holder with respect to the longitudinal axis, and at which a pipe wall of the distributor pipe is bellows-shaped. By this means, length compensation is rendered possible. In particular, a linear expansion of the pipe body may be reduced by the structural refinement of the distributor pipe, namely, by the bellows-shaped refinement. As a result, the mechanical loading of the distributor pipe is produced mainly by the internal pressure. Thus, the wall thickness of the distributor pipe may be set with regard to the internal pressure, which means that as a consequence, the pipe wall may be dimensioned to be markedly thinner.

The linear expansion may be advantageously accommodated by different designs. It is advantageous that a circumferential meander-type, fold-type, or undulation-type bellows is introduced into the pipe wall of the round or slightly oval distributor pipe. In this connection, the distributor pipe may be formed in one piece or multiple pieces. In particular, the distributor pipe may be made up of a plurality of sleeves. Thus, it is advantageous for the pipe wall of the distributor pipe to be formed in the shape of a meander-type bellows, fold-type bellows or undulation-type bellows at the compensating location.

In addition, it is advantageous for the pipe wall of the distributor pipe to be formed, at the compensating location, in the shape of a fold-type bellows having several folds or in the shape of an undulation-type bellows having several undulations. The meander-type, fold-type or undulation-type bellows may also be designed to have multiple layers, and therefore, to be more flexible. In particular, it is therefore advantageous for the pipe wall to be configured with an at least one single-layer or multilayer fold or undulation.

It is also advantageous for at least one holder to be flexurally soft in at least an axial direction. Furthermore, it is advantageous for the holder to be rigid in a radial direction, which is perpendicular to the axial direction. By this means, the holder may provide, first of all, reliable fastening, and may allow, secondly, length compensation.

It is also advantageous that the holder has a screw element and a sleeve, and that an axial expansion of the sleeve in the axial direction is less than a radial expansion of the sleeve in the radial direction; the radial direction being both perpendicular to the axial direction and perpendicular to a screw axis of the screw element. The sleeve may have, for example, a suitable upright profile. Consequently, the flexibility in the axial direction and the rigidity in the radial direction may be specifically selected.

In addition, it is advantageous that at least three holders are provided, that the holder that is flexurally soft in the axial direction is positioned at the distributor pipe as an outer holder, and that an inner holder is rigid in the axial direction. In this connection, exactly one inner holder is preferably configured as a fixed bearing.

Furthermore, it is advantageous that at least one supporting ring is provided, with the aid of which an injector is positionable at the fuel distributor; that the supporting ring has an inner ring and an outer ring; and that there is play in the axial direction between the inner ring and the outer ring. In this connection, it is also advantageous that the inner ring has a bearing surface that is at least partially sloped with respect to an axis of the supporting ring, and that an O-ring is provided, which is supported at the bearing surface and, in the assembled state, acts upon the inner ring radially inwardly with respect to the axis of the supporting ring. By this means, the injector may still be seated at its place and may not experience any overly large shear forces. The supporting ring and the O-ring absorb a portion of the displacement occurring in the event of a linear deformation.

In this connection, the supporting ring is structurally designed to be able to absorb a small, radial displacement. In this connection, it should be noted that the axial linear expansion is typically 10 μm to 100 μm, and therefore, comparatively small displacements have to be compensated for.

It is advantageous that the distributor pipe has several deep-drawn sleeves, which are assembled at their ends, in an axial direction, so as to overlap. In this connection, it is also advantageous that a hydraulic connection is provided in at least one overlapping region, in which the ends of two sleeves assembled in an overlapping manner, overlap. In this manner, the hydraulic connections may be situated in regions of double wall thickness, namely, in the overlapping regions. By this means, the base wall thickness may be reduced, since the bore cut to the hydraulic outlets is situated in the overlapping region. Consequently, the material costs and the mass or the weight may be reduced.

Preferred exemplary embodiments of the present invention are described in greater detail in the following description with reference to the attached drawings, in which corresponding elements are provided with matching reference numerals.

DETAILED DESCRIPTION

Figure 1:
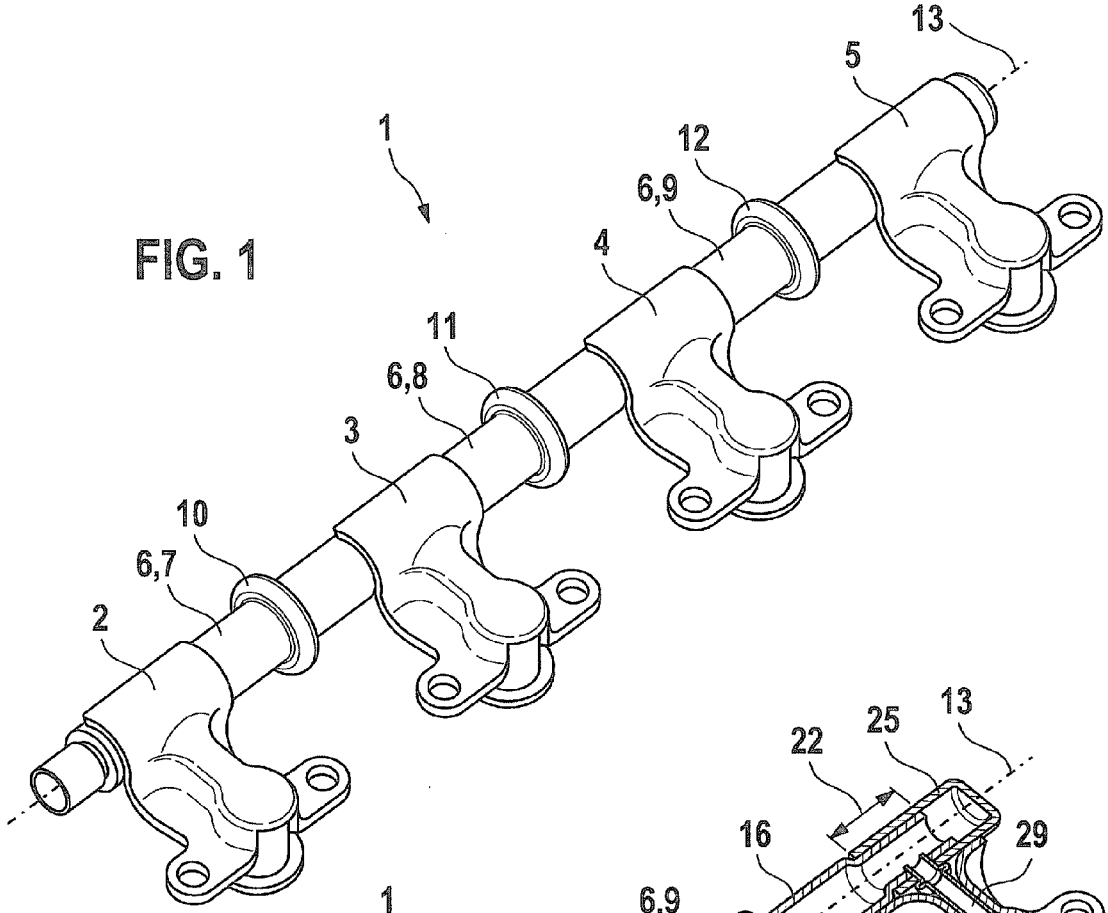
FIG. 1 illustrates a spatial representation of a fuel distributor corresponding to a first exemplary embodiment of the present invention.

FIG. 1 shows a spatial representation of a first exemplary embodiment of a fuel distributor 1 according to the present invention. In this connection, fuel distributor 1 may take, in particular, the form of a fuel distributor rail 1. Fuel distributor 1 is particularly suited for fuel-injection systems of mixture-compressing internal combustion engines having externally supplied ignition. In this connection, fuel distributor 1 is especially suited for a medium pressure system. In this case, the mean pressure for such a medium pressure system may lie in the range of 3 MPa to 10 MPa or 30 bar to 100 bar. In particular, the mean pressure may lie in the range of 5 MPa to 7 MPa or 50 bar to 70 bar. However, the fuel distributor 1 of the present invention is also suited for other application cases.

Fuel distributor 1 has holders 2, 3, 4, 5. In addition, fuel distributor 1 has a distributor pipe 6, which includes, in this exemplary embodiment, a plurality of deep-drawn sleeves 7, 8, 9. Sleeves 7, 8, 9 are individually fitted into each other. Each sleeve 7, 8, 9 has at least one compensating location 10, 11, 12, which is formed in the shape of a meander-type, fold-type or undulation-type bellows. In this connection, circumferential folds, meander-like shapes or undulations 10, 11, 12 may be provided, for example. Compensating locations 10, 11, 12 are used for compensating for a linear deformation, in particular, a linear deformation along a longitudinal axis 13 of distributor pipe 6.

At compensating locations 10, 11, 12, a respective pipe wall 14, 15, 16 (FIG. 2) of sleeves 7, 8, 9 may be single-walled or also made up of several layers, which behave more flexibly with regard to a linear deformation, but are just as rigid with regard to an internal pressure as a corresponding single-layer bellows of equal overall thickness.

Consequently, holders 2 to 5 are axially spaced apart from one another at distributor pipe 6 with respect to longitudinal axis 13. In addition, distributor pipe 6 is designed to allow axial length compensation. It is also possible for one or more holders 2 to 5 to be designed to allow axial length compensation.

Figure 2:
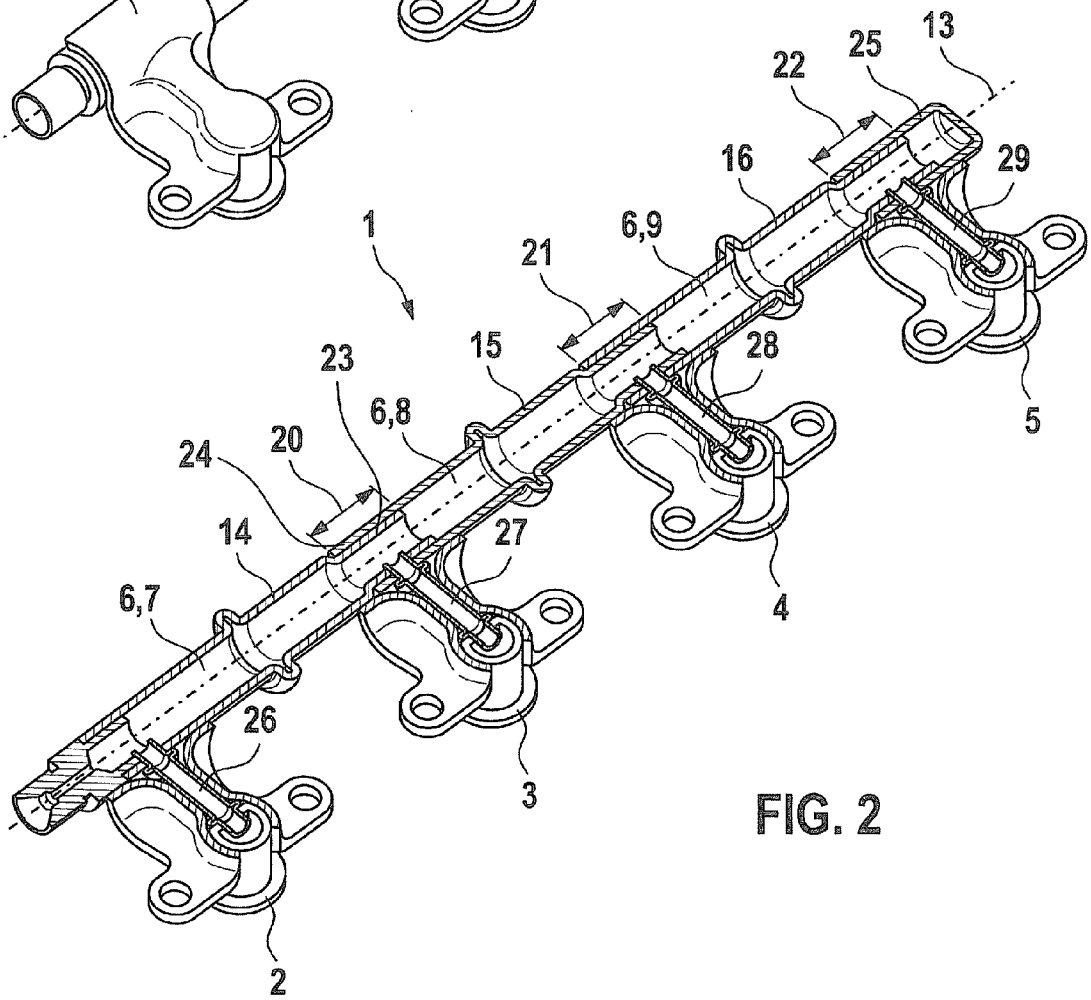
FIG. 2 illustrates an open, spatial representation of the fuel distributor of the first exemplary embodiment shown in FIG. 1.

FIG. 2 shows an open, spatial representation of the fuel distributor of the first exemplary embodiment shown in FIG. 1. Deep-drawn sleeves 7, 8, 9 are assembled at their ends, in the axial direction, so as to overlap. By this means, overlapping regions 20, 21, 22 of respectively overlapping sleeves 7, 8, 9 are formed. For example, an end 23 of pipe wall 14 of sleeve 7 and an end 24 of pipe wall 15 of sleeve 8 overlap in overlapping region 20. Therefore, in each instance, a double wall thickness is produced in overlapping regions 20, 21, 22.

In this connection, it should be noted that overlapping region 22 is formed between sleeve 9 and an end piece 25.

In this exemplary embodiment, holders 2 to 5 accommodate hydraulic connections 26, 27, 28, 29. In this case, hydraulic connections 27, 28, 29 lead into distributor pipe 6 in overlapping regions 20, 21, 22. Therefore, hydraulic connections 27, 28, 29 are provided with double wall thickness in overlapping regions 20, 21, 22.

Figure 3:
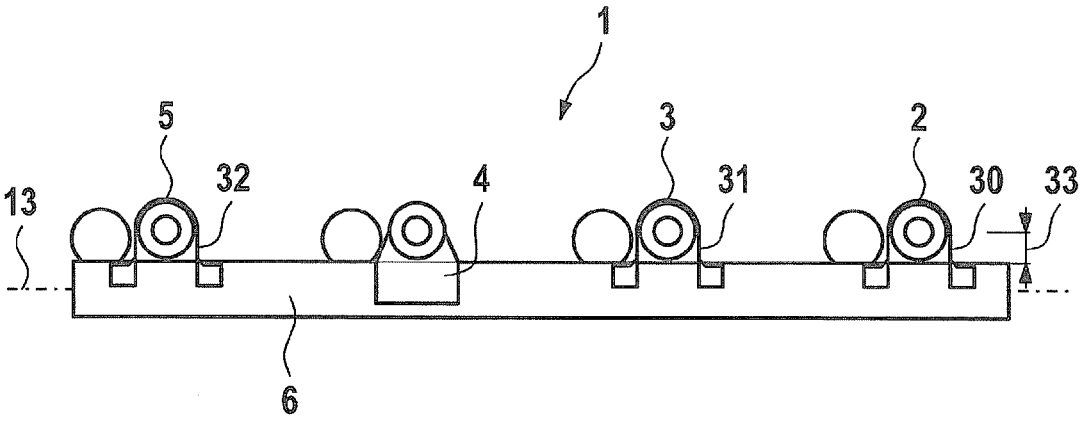
FIG. 3 illustrates a schematic representation of a fuel distributor corresponding to a second exemplary embodiment of the present invention.

FIG. 3 shows a schematic representation of a fuel distributor 1 corresponding to a second exemplary embodiment of the present invention. In this exemplary embodiment, holder 4 is used as a fixed bearing 4, while holders 2, 3, 5 are designed to allow axial length compensation for distributor pipe 6. Holder 4, which is used as a fixed bearing 4, is situated as centrally as possible at distributor pipe 6. In this case, holder 4 is one of the inner holders 3, 4. Outer holders 2, 5 are designed to allow the axial length compensation.

Holder 4 is manufactured as a rigid holder 4. Holders 2, 3, 5 are designed to be flexible in an axial direction, that is, along longitudinal axis 13, and are consequently used, as it were, as floating bearings 2, 3, 5. However, all of holders 2 to 5 are manufactured to be as rigid as possible in a direction radial with respect to longitudinal axis 13. In the case of holders 2, 3, 5, this may be rendered possible, for example, by a suitable upright profile 30, 31, 32 at the respective holder 2, 3, 5. In this connection, the flexibility in the axial direction may be influenced, inter alia, by a bending beam length 33 of upright profile 30, 31, 32.

Figure 4:
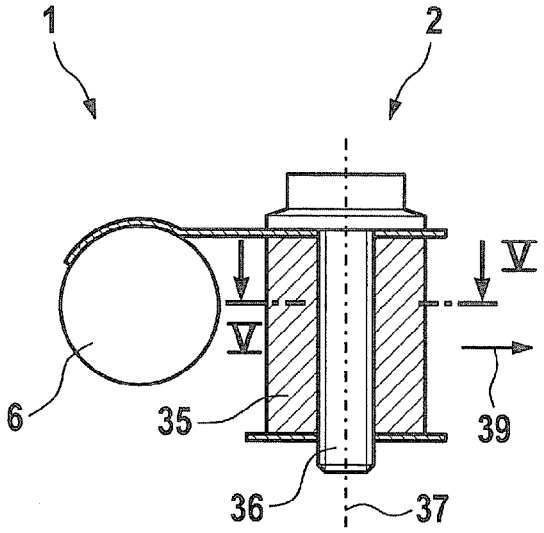
FIG. 4 illustrates a schematic sectional view of a part of a fuel distributor corresponding to a third exemplary embodiment of the present invention.

FIG. 4 shows a schematic sectional view of a part of a fuel distributor 1 corresponding to a third exemplary embodiment of the present invention. In this exemplary embodiment, holder 2 has a sleeve 35 and a screw element 36 taking the form of a screw 36. Sleeve 35 of screw 36 and screw 36 itself are designed to be relatively long with respect to a screw axis 37. In combination with other holders, a fixed and floating bearing principle may be implemented as also described in light of FIG. 3. In this case, a conventional screw connection may be used for the fixed bearing. A screw connection, which is also described further in light of FIG. 5, is used for holder 2.

Figure 5:
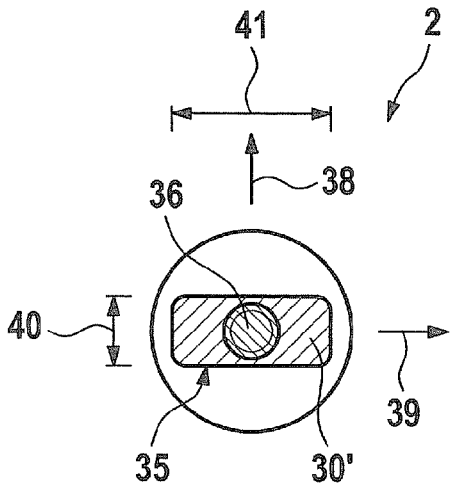
FIG. 5 illustrates a schematic sectional view of a part of the fuel distributor shown in FIG. 4, along the cut, line denoted by V-V.

FIG. 5 shows a part of a schematic sectional view of the holder 2 illustrated in FIG. 4, along the cut line denoted by V-V. Outer sleeve 35 has a suitable upright profile 30. By this means, sleeve 35 is comparatively flexible in an axial direction 38 and comparatively rigid in a radial direction 39. In this case, radial direction 39 is both perpendicular to longitudinal axis 13 of distributor pipe 6, i.e., to axial direction 38, and perpendicular to screw axis 37.

Upright profile 30' is designed so that sleeve 35 has comparatively little material in axial direction 38, but a comparatively large amount of material in radial direction 39. In this exemplary embodiment, a dimension 40 of sleeve 35 in the axial direction is markedly less than a dimension 41 of sleeve 35 in radial direction 39.

By this means, sleeve 35 provides cross-sectional area sufficient for screw 36 to receive enough support in radial direction 39. On the other hand, sleeve 35 only provides a little material in axial direction 38, in order that sleeve 35 is relatively flexible in axial direction 38 and may tilt in response to axial forces. Thus, a relatively large amount of material must be present in radial direction 39. Through this, for example, the upright profile 30' illustrated in FIG. 5 is produced.

Figure 6:
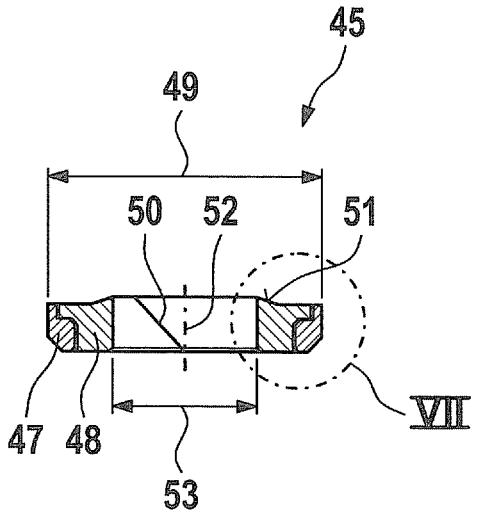
FIG. 6 illustrates a schematic sectional view of a supporting ring of a holder of a fuel distributor according to an exemplary embodiment of the present invention.

FIG. 6 shows a schematic sectional view of a supporting ring 45 of a holder 2 of a fuel distributor 1 according to a possible embodiment of the present invention. In particular, if an embodiment having axially flexible or soft holders 2, 3, 5 is provided, the injection valves should still remain at exactly the same location in the cylinder head. If an axial offset occurs, there is the problem that an injector may tilt on its side by, e.g., a few hundredths of a millimeter, or that the injector is laterally bent, which may affect the performance of the injector. This may be prevented by the design of supporting ring 45. Supporting ring 45 is flexible in radial direction 39 and allows radial play to be offset. In this connection, supporting ring 45 interacts with an O-ring 46 (FIG. 7), which may also compensate for this short distance. Supporting ring 45 is rigid in a direction axial with respect to the injector and supports O-ring 46 in its groove in a manner free from play. In this exemplary embodiment, a small amount of compensation is rendered possible radially. To this end, annular supporting ring 45 is divided in two parts. Supporting ring 45 has an outer ring 47 and an inner ring 48. Outer ring 47 is unslotted and matched exactly to inner cup diameter 49. Inner ring 48 is slotted; in this exemplary embodiment, a slot 50 being provided. By this means, inner ring 48 may be mounted at the injector via the shoulder. Inner ring 48 has an at least partially sloping bearing surface 51. In this connection, bearing surface 51 is oblique with respect to an axis 52 of supporting ring 45. Oblique bearing surface 51 may allow the pressure of O-ring 46 to press inner ring 48 onto outer diameter 53 of the injector in a manner free from play.

Figure 7:
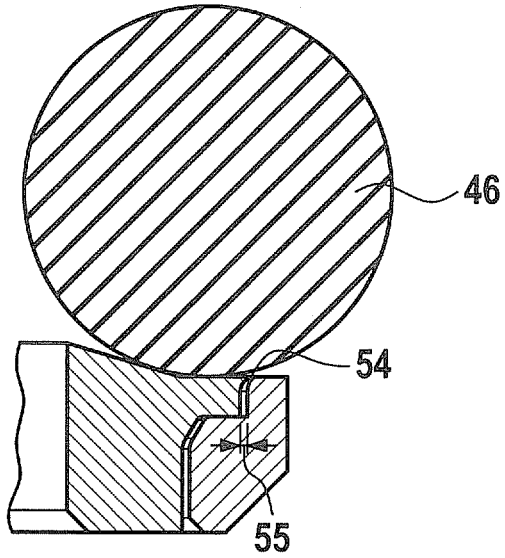
FIG. 7 illustrates the cutout of the supporting ring in FIG. 6, denoted by VII.

FIG. 7 shows, in detail, the cut-out of supporting ring 45 denoted by VII in FIG. 6. Play 55 is present between inner ring 48 and outer ring 47. The desired radial mobility is rendered possible by the play 55 between outer ring 47 and inner ring 48. In order that O-ring 46 is not simply extruded between outer ring 47 and inner ring 48, there is a supporting overlap 54 right here.

Figure 8:
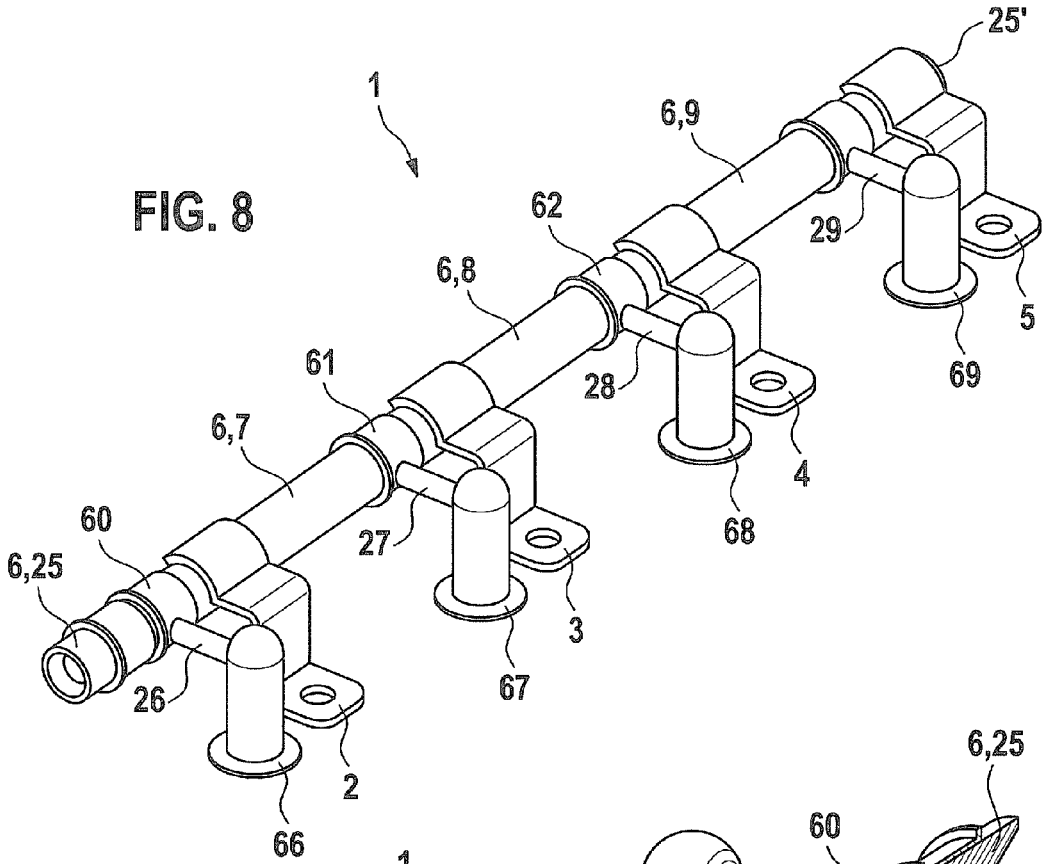
FIG. 8 illustrates a spatial representation of a fuel distributor corresponding to a fourth exemplary embodiment of the present invention.

FIG. 8 shows a spatial representation of a fuel distributor 1 corresponding to a fourth exemplary embodiment of the present invention. In this exemplary embodiment, distributor pipe 6 has multiple parts. In this connection, distributor pipe 6 has several deep-drawn sleeves 7, 8, 9, which may be shaped the same way. In addition, an end piece 25 is provided. Deep-drawn sleeves 7, 8, 9 overlap one another at their ends. In this case, sleeves 7, 8, 9 are intermated. Hydraulic connections 26, 27, 28, 29 are provided in overlapping regions 20, 21 of double wall thickness. End piece 25, which is formed as a hydraulic connection 26, may be a lathed part. A further end piece 25', which takes the form of an end cap 25', may be designed as a separate, simple deep-drawn part.

The advantage of this embodiment is that, for example, in the case of a four-cylinder engine, three identical, inexpensive sleeves 7, 8, 9 may then be assembled. As a further advantage, a base wall thickness may be reduced, since a possible site of fracture, which is given by bore cuts to the hydraulic outlets, may be situated in the overlapping regions 20, 21, 22 having a double wall thickness. This may allow the material costs to be reduced. In addition, it is possible to reduce the weight or the mass of fuel distributor 1.

Furthermore, holes that are provided may be produced by punching, which is more cost-effective than drilling. Moreover, hole positions may be varied, so that individual tool parts may be used for different engine projects. In this connection, it is also possible for such holes to be constructed to be oval to reduce damaging stress peaks. In addition, a pipe cross-section of distributor pipe 6 may also be designed to be slightly oval, which means that in response to a given internal pressure, distributor pipe 6 is circularly deformed, and supporting compressive stresses are generated at the inner wall of the bore cuts. Furthermore, the increase in volume, which occurs in response to the deformation from an oval pipe cross-section to a circular cross-section, may allow distributor pipe 6 to assume a pressure-damping or storing function. By this means, damaging compression amplitudes in distributor pipe 6 may be reduced.

The three deep-drawn sleeves 7, 8, 9 have, on one end, respective segments 60, 61, 62 having increased inner diameters, which means that sleeves 7, 8, 9 may be fit into each other. This is also illustrated in FIG. 9.

Figure 9:
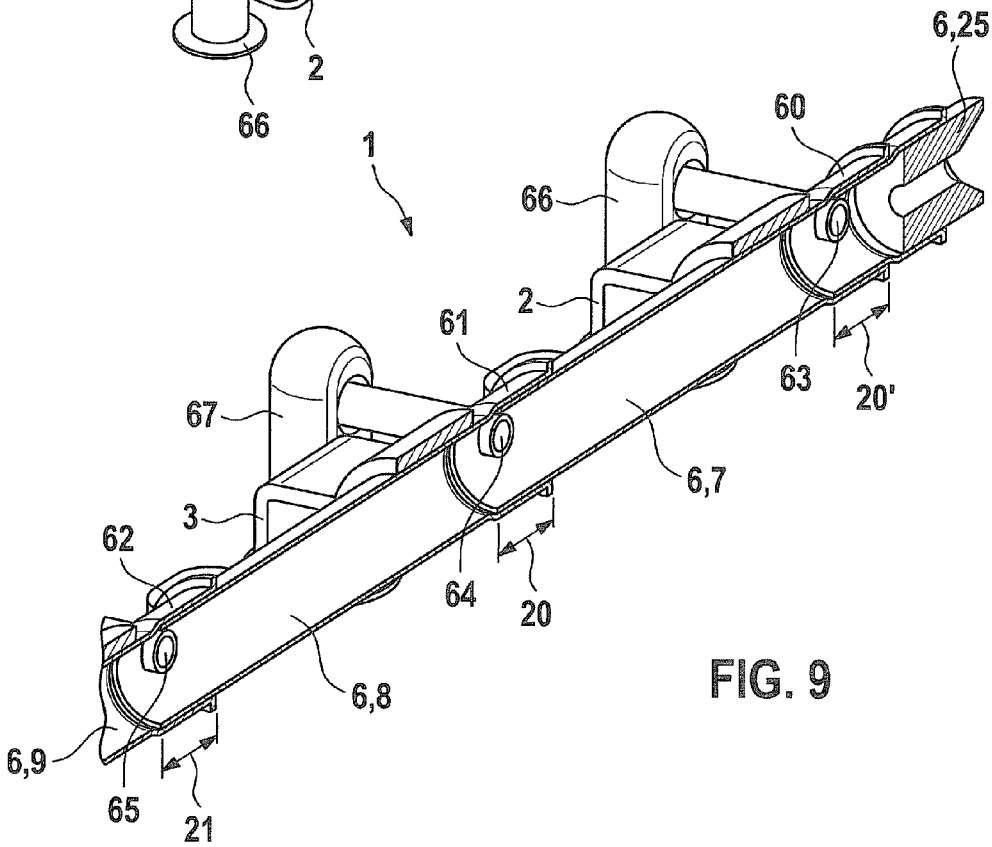
FIG. 9 illustrates an open, spatial representation of the fuel distributor shown in FIG. 8.

FIG. 9 shows an open, spatial representation of the fuel distributor 1 illustrated in FIG. 8. A further overlapping region 20', which is shaped comparably to overlapping regions 20, 21, 22, is provided for end piece 25.

In overlapping regions 20', 20, 21, 22, holes 63, 64, 65 were punched in at the two ends of sleeves 7, 8, 9 and end piece 25 during the deep-drawing process. When sleeves 7, 8, 9 are fitted into each other, holes 63, 64, 65 are positioned appropriately with respect to one another. At these locations, e.g., cups 66, 67, 68, 69 are attached directly or via an intermediate pipe. This allows hydraulic connections 26 to 29 to be produced.

The ends of distributor pipe 6 are closed by deep-drawn end cap 25' and high-pressure connection 25. By this means, a lateral high-pressure connection may also be produced. It is also possible for a pressure sensor or the like to be provided.

In addition, holders 2, 3, 4, 5 are provided that are connected to distributor pipe 6. In this exemplary embodiment, the holders are produced separately from hydraulic connections 26 to 29 for the injectors.

During the manufacture of fuel distributor 1, the individual parts may be fixed in position by clipping and subsequently hard-soldered. In this connection, a soldering paste or soldering rings may be used, for example.

The present invention is not limited to the exemplary embodiments described.

What is claimed is:

1. A fuel distributor, comprising:

a distributor pipe having a longitudinal axis;

a first holder; and at least one second holder; wherein the first holder and the second holder are situated at the distributor pipe axially set apart from one another with respect to the longitudinal axis; wherein at least one of the first and second holders is configured to allow axial length compensation, and wherein at least one of the first and second holders is flexurally soft and configured to be displaced in at least an axial direction corresponding to the longitudinal axis.

2. The fuel distributor according to claim 1, wherein the distributor pipe is configured to allow axial length compensation, and wherein the distributor pipe has at least one compensating location, which is situated between the first holder and the second holder with respect to the longitudinal axis, and at which a pipe wall of the distributor pipe is bellows-shaped.

3. The fuel distributor according to claim 1, wherein each of the first and second holders is configured to be rigid in a radial direction, which is perpendicular to the axial direction.

4. The fuel distributor according to claim 1, wherein each of the first and second holders has a screw element and a sleeve, an axial dimension of the sleeve in the axial direction being less than a radial dimension of the sleeve in the radial direction, and the radial direction being both perpendicular to the axial direction and perpendicular to a screw axis of the screw element.

5. The fuel distributor according to claim 1, wherein at least three holders are provided, holders which are flexurally soft in the axial direction being positioned at the distributor pipe as outer holders, and an inner holder, situated between the outer holders, being configured to be rigid in the axial direction.

6. The fuel distributor according to claim 1, wherein at least one supporting ring is provided that is mountable on an injector, with the aid of which the injector is positionable at the fuel distributor, the supporting ring having an inner ring and an outer ring, and a play in the axial direction being present between the inner ring and the outer ring.

7. The fuel distributor according to claim 6, wherein the inner ring has a bearing surface that is at least partially sloped with respect to an axis of the supporting ring; and an O-ring is provided, which is supported at the bearing surface and, in an assembled state, acts upon the inner ring radially inwardly with respect to the axis of the supporting ring.

8. The fuel distributor according to claim 1, wherein the distributor pipe is configured to allow axial length compensation, and wherein the distributor pipe has a plurality of deep-drawn sleeves, which are assembled at their respective ends, in an axial direction, so as to overlap at respective overlapping regions.

9. The fuel distributor according to claim 8, wherein a hydraulic connection is provided in at least one of the overlapping regions.

* * * * *